US012330037B2

(12) United States Patent
Gao

(10) Patent No.: US 12,330,037 B2
(45) Date of Patent: Jun. 17, 2025

(54) SUPPORTING DEVICE FOR PUNCHING BAG

(71) Applicant: LinYi AiBeiJian Sports Goods Co., Ltd., Linyi (CN)

(72) Inventor: Huijin Gao, Linyi (CN)

(73) Assignee: LINYI AIBEIJIAN SPORTS GOODS CO., LTD., Linyi (CN)

( * ) Notice: Subject to any disclaimer, the term of this patent is extended or adjusted under 35 U.S.C. 154(b) by 76 days.

(21) Appl. No.: 18/384,881

(22) Filed: Oct. 29, 2023

(65) Prior Publication Data

US 2024/0050829 A1 Feb. 15, 2024

Related U.S. Application Data

(63) Continuation-in-part of application No. PCT/CN2022/070405, filed on Jan. 6, 2022.

(30) Foreign Application Priority Data

Dec. 20, 2021 (CN) ..... 202123205319.2

(51) Int. Cl.
*A63B 69/22* (2006.01)

(52) U.S. Cl.
CPC ..... *A63B 69/224* (2022.08)

(58) Field of Classification Search
CPC ..... A63B 69/22; A63B 69/224; A63B 69/24; A63B 69/244; A63B 2071/026; A63B 2209/14; A63B 2210/50
See application file for complete search history.

(56) References Cited

U.S. PATENT DOCUMENTS

| | | | | |
|---|---|---|---|---|
| 4,938,478 | A * | 7/1990 | Lay | A63B 69/0091 473/423 |
| 11,253,765 | B1 * | 2/2022 | Huang | A63B 69/32 |
| 12,251,612 | B2 * | 3/2025 | Hoang | A63B 69/224 |
| 2014/0128226 | A1 * | 5/2014 | Chang | A63B 69/22 482/83 |
| 2023/0364482 | A1 * | 11/2023 | Hoang | A63B 69/224 |

* cited by examiner

*Primary Examiner* — Joshua Lee

(74) *Attorney, Agent, or Firm* — MATTHIAS SCHOLL P.C.; Matthias Scholl

(57) ABSTRACT

A supporting device for a punching bag includes a hollow tubular pillar; a connector; a flange body; a rubber shock absorber; and a support tray. The connector includes a first end and a second end; the second end is bigger than the first end in diameter; the first end is disposed into the hollow tubular pillar. The connector includes a first connection hole, and the hollow tubular pillar includes a second connection hole. The connector and the hollow tubular pillar are fixed by a locking screw through the first connection hole and the second connection hole. The flange body includes a central blind hole, and the second end of the connector is disposed into the central blind hole. The flange body further includes a radial base. The circumference of the radial base includes a plurality of mounting holes configured to receive a counterweight unit to stabilize the supporting device.

4 Claims, 3 Drawing Sheets

SUPPORTING DEVICE FOR PUNCHING BAG

CROSS-REFERENCE TO RELATED APPLICATIONS

This application is a continuation-in-part of International Patent Application No. PCT/CN2022/070405 with an international filing date of Jan. 6, 2022, designating the United States, and further claims foreign priority benefits to Chinese Patent Application No. 202123205319.2 filed Dec. 20, 2021. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to the field of rubber, and more particularly to a supporting device for a punching bag.

Conventional punching bags include two parts: the upper punching bag body and the lower counterweight base. The connection between the upper punching bag body and the lower counterweight base is generally using a simple embedding mode, that is, a rod-shaped pillar extends from the upper punching bag body and is directly inserted into the lower counterweight base to achieve connection. Therefore, to ensure the stability of the connection, the rod-shaped pillar of the upper punching bag body is generally longer, which is inconvenient for product packaging, occupies a larger package volume, consuming more logistics resources and increasing the logistics and circulation costs.

SUMMARY

The disclosure provides a supporting device for a punching bag comprising detachable parts, which is easy to store and saves the transportation space.

In accordance with one embodiment of the disclosure, provided is a supporting device for a punching bag, comprising a hollow tubular pillar; a connector; a flange body; a rubber shock absorber; and a support tray; the connector is tubular, and comprises a first end and a second end; the second end is bigger than the first end in diameter; the first end is disposed into the hollow tubular pillar; the connector comprises a first connection hole, and the hollow tubular pillar comprises a second connection hole; the connector and the hollow tubular pillar are fixed by a locking screw through the first connection hole and the second connection hole; the flange body comprises a central blind hole, and the second end of the connector is disposed into the central blind hole; the flange body further comprises a radial base; a circumference of the radial base comprises a plurality of mounting holes configured to receive a counterweight unit to stabilize the supporting device; the support tray is a disc structure, comprising at least two support rods; one end of each support rod is fixed to the hollow tubular pillar, and the other end is fixed to the support tray; and the support tray is configured to support a punching bag body; and the rubber shock absorber comprises a central hole; the hollow tubular pillar is disposed through the central hole; and the rubber shock absorber is disposed below and leans against the support tray.

In a class of this embodiment, a periphery of the support tray is bent upwards by 90 degrees to form a smooth contact surface.

In a class of this embodiment, the first end of the connector is a shrinking end towards the hollow tubular pillar thus facilitating the connection of the connector and the hollow tubular pillar.

In a class of this embodiment, a step is disposed in the central blind hole of the flange body to divide the central blind hole into a first part and a second part, and a size of the first part is larger than that of the second part; the locking screw is located in the first part and supported by the step, and the second end of the connector is firmly fixed in the second part.

The following advantages are associated with the supporting device for a punching bag of the disclosure. The periphery of the support tray is bent upwards by 90 degrees to form a smooth contact surface, preventing injury when users accidentally kick and hit the edge of the support tray. The rubber shock absorber is flexible and thus can withstand alternating stress, improving the hitting resistance capacity. The supporting body of the supporting device for a punching bag comprises the connector and the hollow tubular pillar, which are detachably connected to each other, thus shortening the packaged structure of the supporting device for a punching bag, and facilitating the transportation of the device. The occupied space of the device is smaller, making it easy to move, transport, store, thus reducing the logistics costs.

Figure 1:
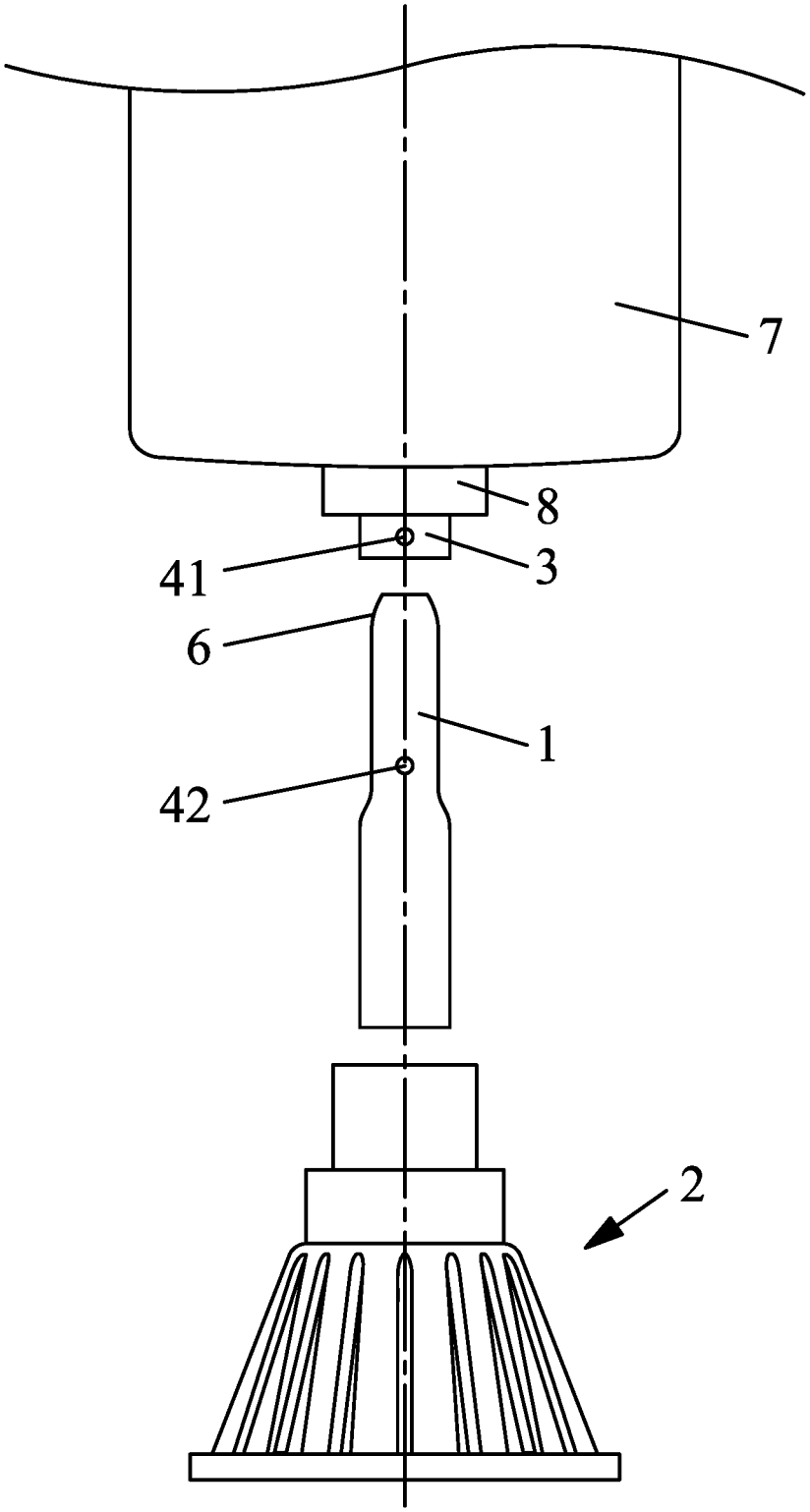
FIG. 1 is a schematic diagram of a supporting device for a punching bag according to one embodiment of the disclosure.

In the drawings, the following reference numbers are used: 1. Connector; 2. Flange body; 3. Hollow tubular pillar; 41. Second connection hole; 42. First connection hole; 5. Mounting hole; 6. Shrinking end; 7. Punching bag body; 8. Rubber shock absorber; 9. Support tray; 10. Support rod; 11. Fixing screw.

DETAILED DESCRIPTION

To further illustrate the disclosure, embodiments detailing a supporting device for a punching bag are described below. It should be noted that the following embodiments are intended to describe and not to limit the disclosure.

Figure 2:
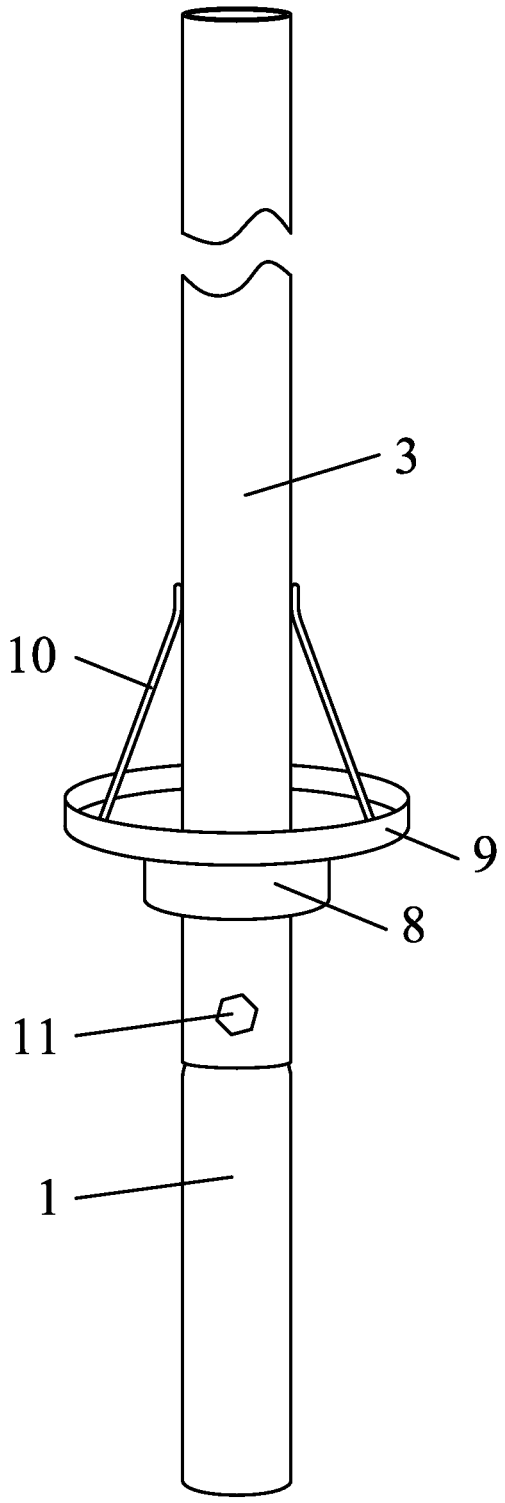
FIG. 2 is an assembly diagram of the connector and the hollow tubular pillar of a supporting device for a punching bag according to one embodiment of the disclosure.
Figure 3:
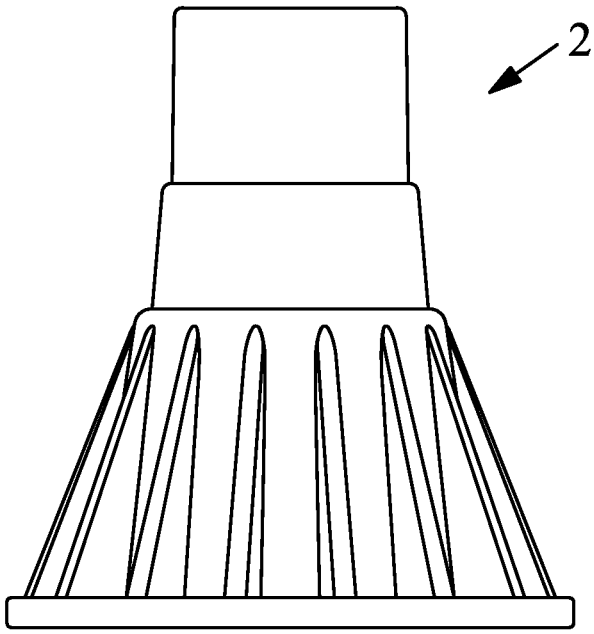
FIG. 3 is a schematic diagram of a flange body according to one embodiment of the disclosure.
Figure 4:
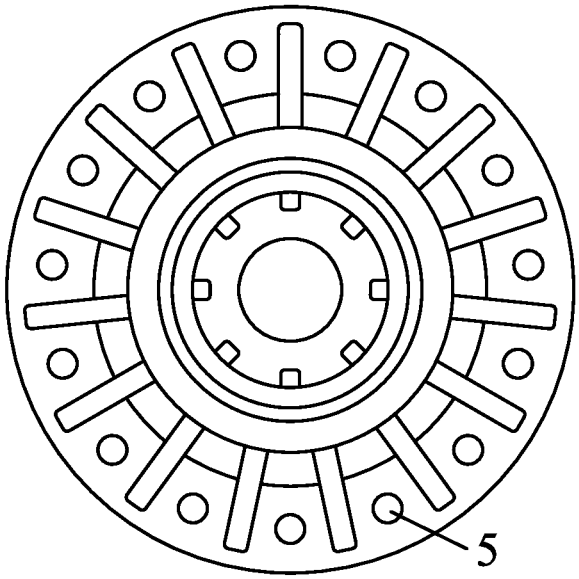
FIG. 4 is a bottom view of a flange body according to one embodiment of the disclosure.

As shown in FIGS. 1-4, the disclosure provides a supporting device for a punching bag comprising a hollow tubular pillar 3, a connector 1, a flange body 2, a rubber shock absorber 8, and a support tray 9. The rubber shock absorber 8 comprises a central hole; the hollow tubular pillar 3 is disposed through the central hole; and the rubber shock absorber 8 is disposed below and leans against the support tray 9. The support tray 9 is a disc structure, comprising at least two support rods 10; one end of each support rod 10 is fixed to the hollow tubular pillar 3, and the other end is fixed to the support tray 9; and the support tray 9 is configured to support a punching bag body 7. The connector 1 is tubular, and comprises a first end and a second end; the second end is bigger than the first end in diameter; the first end is disposed into the hollow tubular pillar 3; the connector 1 comprises a first connection hole 42, and the hollow tubular pillar 3 comprises a second connection hole 41; the connector 1 and the hollow tubular pillar 3 are fixed by a locking screw 11 through the first connection hole 42 and the second connection hole 41. The punching bag body 7 is disposed around the hollow tubular pillar 3. The flange body 2 comprises a central blind hole, and the second end of the connector 1 is disposed into the central blind hole. The flange body 2 further comprises a radial base; the circumference of the radial base comprises a plurality of mounting holes 5 configured to receive a counterweight unit to stabilize the supporting device.

The rubber shock absorber 8 is flexible and thus can withstand alternating stress.

The periphery of the support tray 9 is bent upwards by 90 degrees to form a smooth contact surface, preventing injury when users accidentally kick and hit the edge of the support tray 9.

The first end of the connector 1 is a shrinking end 6 towards the hollow tubular pillar 3 thus reducing the resistance and friction during connection, facilitating the connection of the connector and the hollow tubular pillar 3, making the connection more flexible.

A step is disposed in the central blind hole of the flange body 2 to divide the central blind hole into a first part and a second part, and a size of the first part is larger than that of the second part; the locking screw 11 is located in the first part and supported by the step, and the second end of the connector 1 is firmly fixed in the second part.

It will be obvious to those skilled in the art that changes and modifications may be made, and therefore, the aim in the appended claims is to cover all such changes and modifications.

What is claimed is:

1. A supporting device for a punching bag, comprising:

1) a hollow tubular pillar;

2) a connector;

3) a flange body;

4) a rubber shock absorber; and 5) a support tray;

wherein:

the connector is tubular, and comprises a first end and a second end; the second end is bigger than the first end in diameter; the first end is disposed into the hollow tubular pillar; the connector comprises a first connection hole, and the hollow tubular pillar comprises a second connection hole; the connector and the hollow tubular pillar are fixed by a locking screw through the first connection hole and the second connection hole;

the flange body comprises a central blind hole, and the second end of the connector is disposed into the central blind hole;

the flange body further comprises a radial base; a circumference of the radial base comprises a plurality of mounting holes configured to receive a counterweight unit to stabilize the supporting device;

the support tray is a disc structure, comprising at least two support rods; one end of each support rod is fixed to the hollow tubular pillar, and the other end is fixed to the support tray; and the support tray is configured to support a punching bag body; and the rubber shock absorber comprises a central hole; the hollow tubular pillar is disposed through the central hole; and the rubber shock absorber is disposed below and leans against the support tray.

2. The device of claim 1, wherein a periphery of the support tray is bent upwards by 90 degrees to form a smooth contact surface.

3. The device of claim 1, wherein the first end of the connector is a shrinking end towards the hollow tubular pillar thus facilitating a connection between the connector and the hollow tubular pillar.

4. The device of claim 1, wherein a step is disposed in the central blind hole of the flange body to divide the central blind hole into a first part and a second part, and a size of the first part is larger than that of the second part; the locking screw is located in the first part and supported by the step, and the second end of the connector is firmly fixed in the second part.

* * * * *